US006839923B2

(12) United States Patent
Blessman

(10) Patent No.: US 6,839,923 B2
(45) Date of Patent: Jan. 11, 2005

(54) METHOD AND DEVICE FOR INSERTING A PILLOW INTO A PILLOWCASE

(76) Inventor: Brad Blessman, 1231 S. Clayton, Denver, CO (US) 80210

( * ) Notice: Subject to any disclaimer, the term of this patent is extended or adjusted under 35 U.S.C. 154(b) by 0 days.

(21) Appl. No.: 10/387,655

(22) Filed: Mar. 12, 2003

(65) Prior Publication Data

US 2004/0177444 A1 Sep. 16, 2004

(51) Int. Cl.[7] ..... A47G 9/10
(52) U.S. Cl. ..... 5/489; 5/490; 5/636
(58) Field of Search ..... 5/489, 490, 639, 5/640, 636, 81.1 R, 81.1 HS; 53/257, 262, 261

(56) References Cited

U.S. PATENT DOCUMENTS

| | | | | |
|---|---|---|---|---|
| 359,617 A | | 3/1887 | Leonard | |
| 743,505 A | * | 11/1903 | Heffner | 53/255 |
| 804,456 A | | 11/1905 | Condo | |
| 827,008 A | | 7/1906 | Gilmore | |
| 1,140,583 A | | 5/1915 | Elliott | |
| 1,144,187 A | | 6/1915 | Garren | |
| 1,665,907 A | * | 4/1928 | Coda | 53/262 |
| 1,712,711 A | | 5/1929 | Morgan et al. | |
| 1,743,329 A | | 1/1930 | Dougherty | |
| 2,778,324 A | | 1/1957 | Mattson | 107/46 |
| 2,935,107 A | | 5/1960 | Bertelsen et al. | 146/215 |
| 3,448,913 A | | 6/1969 | Wolff | 229/14 |
| 3,837,634 A | | 9/1974 | Cobb | 269/289 |
| 3,936,087 A | * | 2/1976 | Alexander | 294/1.1 |
| 4,012,799 A | * | 3/1977 | Rutherford | 5/81.1 R |
| 4,192,494 A | | 3/1980 | Mima | 269/289 |
| 4,749,011 A | * | 6/1988 | Rylander | 141/316 |
| 4,761,872 A | * | 8/1988 | Buettner et al. | 29/451 |
| 5,472,790 A | | 12/1995 | Thompson | 428/500 |
| 5,511,255 A | * | 4/1996 | Schuerch | 5/81.1 T |
| 5,673,446 A | | 10/1997 | Moen et al. | 5/489 |
| 5,716,033 A | * | 2/1998 | Gibson | 248/95 |
| 6,371,470 B1 | | 4/2002 | Ward | 269/289 |
| 6,460,841 B1 | | 10/2002 | Durr | 269/289 |
| 6,651,970 B2 | | 11/2003 | Scott | 269/289 |

FOREIGN PATENT DOCUMENTS

| | | |
|---|---|---|
| GB | 2 248 177 A | 4/1992 |
| WO | WO 01/26524 A1 | 4/2001 |

* cited by examiner

*Primary Examiner*—Michael Trettel
(74) *Attorney, Agent, or Firm*—Sheridan Ross P.C.

(57) ABSTRACT

A method and device that provides an easily repeatable way in which to insert pillows into pillowcases. A flexible relatively thin sheet of material is provided that is sized and configured so as to attain a generally U-shaped configuration for insertion into a pillowcase, thereby creating a three-dimensional cavity through which a pillow can be inserted. The device can then be easily extracted from the pillowcase by merely sliding it out once the pillow is in place.

10 Claims, 5 Drawing Sheets

METHOD AND DEVICE FOR INSERTING A PILLOW INTO A PILLOWCASE

FIELD OF THE INVENTION

The present invention is directed to a method and device for insertion of a pillow into a pillowcase, and more particularly is directed to a flexible, preferably planar, device that facilitates ready insertion into a pillowcase in order to create a three dimensional cavity into which a pillow can be inserted.

BACKGROUND OF THE INVENTION

Traditional methods of inserting a pillow into a pillowcase create inconveniences to the individual trying to accomplish the task. There are many traditional methods including: holding the pillow under the chin or in one's teeth and then sliding the pillow with a shaking fashion; laying a pillow on a bed and then pushing the pillow into the pillowcase; and inverting the pillowcase, putting one's hand or arm into the pillow case and grasping the end of a pillow and pulling it through to the other side while reverting the pillowcase to its original orientation, etc.

Each of the methods mentioned above are awkward and inefficient. The nature of the flexibility of the fabric and close approximate size of the case or slip makes it difficult for one to quickly insert a pillow into a case or slip. The fabric cannot hold its own form and therefore a pillow must be forced or shaken into the case. Much time is lost during this process. In industries that require many pillows to be covered with new slips or cases time could be saved if there was an invention to aid in this process.

Moen, U.S. Pat. No. 5,673,446, discloses a device to assist the changing of a pillowcase. Moen, however, utilizes several sticks and a locking ball system. The user in effect must lock a pillow between two sticks before inserting the pillow in the pillowcase. Leonard, U.S. Pat. No. 359,617, requires the user to engage pillow corners with hooks and/or require that loops be sewn into the pillow cases. Morgan, U.S. Pat. No. 1,712,711, requires the use of an awkward metal frame. Doughterty, U.S. Pat. No. 1,743,329, requires the use of permanent clips.

There is, therefore, a long felt and unsolved need for an easy, inexpensive and efficient method and device for inserting a pillow into a pillowcase.

SUMMARY OF THE INVENTION

The present invention is generally directed to a method and device to make the process of inserting a pillow into a pillowcase easier and more efficient. One aspect of the current invention allows for a device to be inserted into a pillowcase, thus holding the case open and giving the case a definite shape. Because the pillowcase is opened in three dimensions, it acquires a shape such that a pillow may easily be inserted without wrestling the pillow into the case. The present method and device for inserting of a pillow into a pillowcase is useful in the hospitality and medical industries, and more generally in any industry that utilizes many beds and pillows and requires the changing thereof on a frequent basis. The creation of efficiency in a pillow inserting process allows workers in these fields to reduce the amount of repetitive strain on their arms and wrists associated with traditional methods of inserting a pillow into a pillow case.

Since pillows come in several sizes, the present device can be modified to be larger or smaller dependent on the size of the pillows and pillowcases or slips. One embodiment of the invention is created with flexible material, such as lexan polycarbonate, a material that can be bent into a shape but can return to the original state after the use. Using this type of material, smaller embodiments of the invention may not be necessary. The material allows for the user to bend it into smaller configurations to accommodate smaller pillows.

In one particular invention, a pillow insertion device comprises a relatively thin layer of a flexible material that has a generally rectangular shape. The device has two longitudinal edges and an insertion edge that is rounded to facilitate easy insertion into a pillowcase. A user interface edge opposite the rounded edge preferably has a handle or gripping structure to facilitate insertion and removal of the device from a pillowcase. Handholds having an elliptical shape can be formed in the thin layer for such purpose. In a preferred embodiment, the device has a width of approximately at least 1½ times the width of a pillowcase into which the device is inserted and such device is preferably manufactured from a flexible plastic material having memory characteristics such that the device is urged back into a planar configuration when not being manipulated.

In yet another embodiment of the present invention, a windowed enclosure is operatively associated with the device that is capable of retaining separate items printed or graphic material which may be used to inform when a pillowcase was last changed, etc.

The present invention further includes a method for inserting a pillow into a pillowcase utilizing one or more of the embodiments of the present invention. Such method comprises opening a pillowcase, inserting a pillow insertion device of the present invention into the pillow insertion side of the pillowcase, sliding a pillow between the surface of the pillow insertion device and the pillowcase and finally removing the pillow insertion device therefrom.

Other aspects and embodiments of the present invention can be further understood by referring to the drawings below as well as to the Detailed Description of the Preferred Embodiments of the present invention. It should be understood that all of such embodiments comprise various aspects and embodiments of the present invention and that the Summary of the Invention is by no means to be interpreted as limiting in any regard.

DETAILED DESCRIPTION

One aspect of the present invention is directed to a device 18 to facilitate the insertion of a pillow into a pillowcase, such device comprising a generally planar sheet of flexible material. The material can be made from any suitable composition, and may, therefore, comprise paper, cardboard, plastic, rubber, fiberglass, thin metal, etc. In a preferred embodiment, the material utilized is a plastic material that has considerable flexibility associated therewith so that the planar material can be configured into a generally U-shaped configuration and/or rolled into a round configuration to facilitate insertion into a pillowcase opening. Once inserted, the device is permitted to expand and return to its normal static configuration, however, the pillowcase itself will at such point restrain the device from achieving a planar configuration. Thus, a three-dimensional cavity will be formed inside the interior regions of a pillowcase and a pillow can therefore be readily inserted within such cavity. Once a pillow is inserted, the device can then be readily removed from the pillowcase by merely pulling one end of the device nearest the pillowcase opening, thereby permitting the sliding of the device away from the pillowcase. As one of skill in the art will appreciate, a slick surface of the device is preferred in order to reduce any type of frictional contact between the device and a pillowcase, thus facilitating easy insertion and removal of the device from a pillowcase. Moreover, as stated above, the flexible nature of the device should be such that it has a "memory" which returns the device to a substantially planar orientation when not in use. Such a planar orientation is desirable, for example, to facilitate storage of such device underneath a mattress, for example, between a mattress and a box spring. Similarly, the device can be hung in a closet, near a bedroom, on a maid's cart, etc. so that it is easily accessible for use.

It should be understood that the material utilized to manufacture the present device, while having flexibility in a dimension so as to permit the longitudinal edges of the device to be mated together, should preferably have a sufficient amount of stiffness in the longitudinal direction of the device so as to facilitate insertion of the device without undesired bending thereof. One of ordinary skill in the art will understand the particular thickness of the material to be used to achieve such operational objectives.

Figure 1:
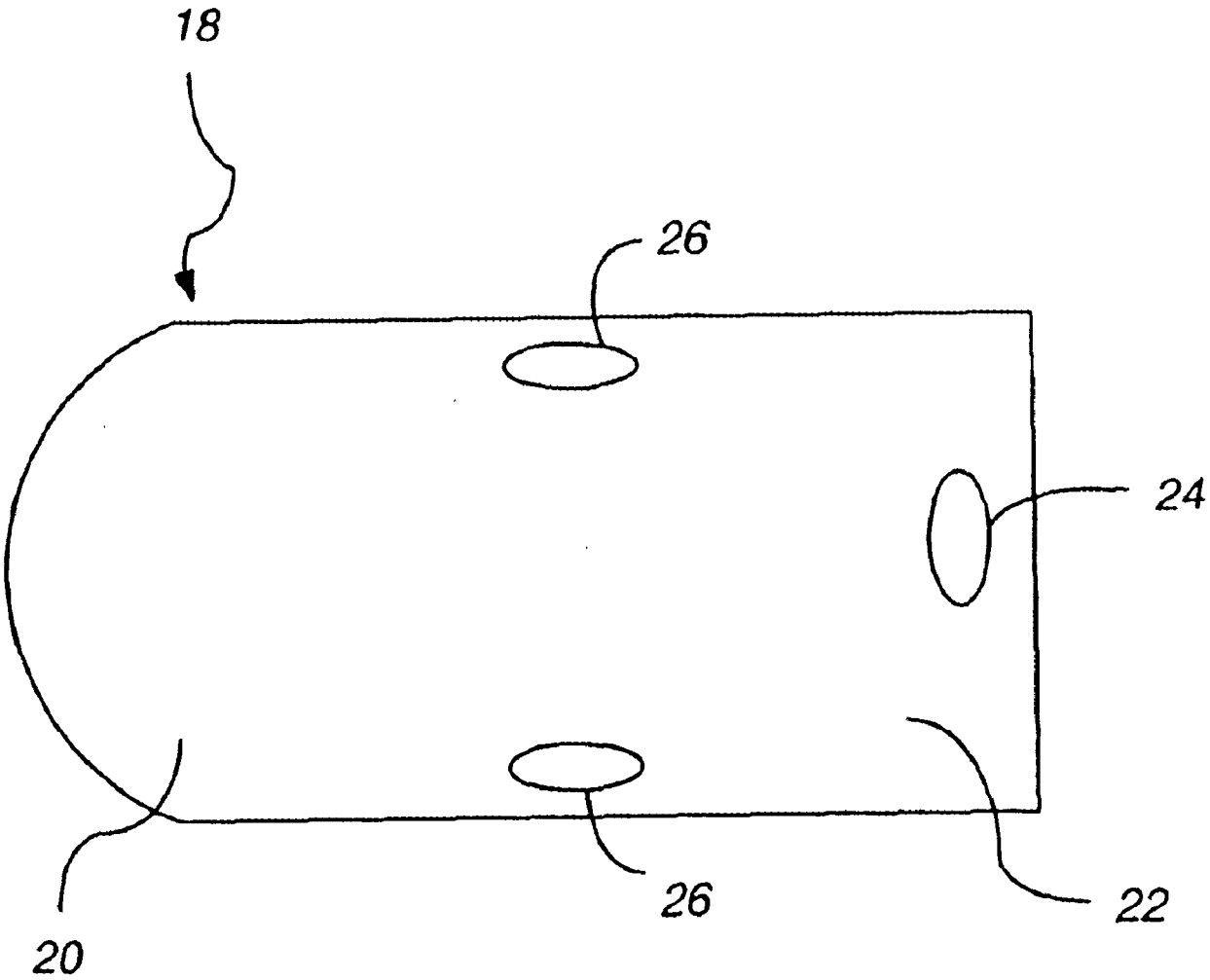
FIG. 1 represents one embodiment of the current invention 18. The pillowcase insertion edge 20 is preferably rounded and is located at one edge of the current invention. The user interface edge 22 is located at the opposite end of the device. Handles 24 and 26 are cut out of the invention or can be attached in the same areas.

In particular embodiments of the present invention 18, handholds are provided for in one or more locations around the periphery of the device. For example, in one preferred embodiment, three separate handholds are provided, one on each lateral side of the periphery of the device and one at the end of the device, to facilitate insertion and withdrawal of the device from a pillowcase. The two lateral side handholds 26 provide hand grips such that the device can be curled in the longitudinal direction prior to the insertion of the device into a pillowcase. The handhold 24 utilized to remove the device from a pillowcase is depicted in, for example, FIG. 1.

In lieu of the cut-out handholds 26, other suitable textured surfaces, etc. (not shown) can be utilized to facilitate the folding/rolling of the planar material into a desired configuration for insertion into a pillow. Preferably, in such embodiments, only a particular handhold section would have a somewhat roughened texture to facilitate gripping of the material (e.g., by one hand) and such roughened textured surface would not substantially interfere with the insertion of the device into a pillowcase.

Figure 3:
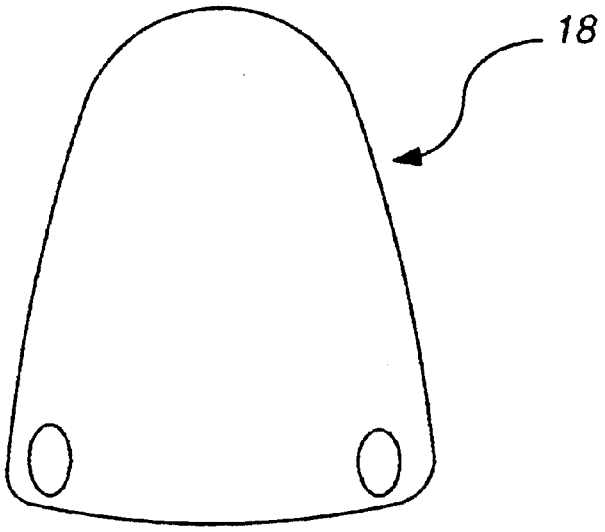
FIG. 3 shows an alternative embodiment of the present invention having a roughly triangular shape with the vertex of an isosceles-shaped device being inserted first into a pillowcase.

The general geometric shape of the device can be of any desired form so long as the objective of opening up a pillowcase to create a three-dimensional space through which a pillow can be inserted is achieved. Preferably, a generally rectangular or "tombstone" shape is used, however, other shapes (e.g., see FIG. 3) can be used, such as a triangular shaped device. Other embodiments have sections with apertures formed therein to reduce the amount of material required, reduce weight, facilitate bending/folding characteristics, etc. Structural grooves or creases, etc. can be used to add strength to certain sections to achieve the desired conformations of the device.

While the preferred embodiment to the present invention is normally a flat planar piece of flexible plastic that can be configured into a substantially U-shaped shape, or rolled over upon itself for insertion into a pillowcase, various other types of configurations are also within the scope of the present invention. For example, an accordion-type compression of material to facilitate insertion into a pillowcase (not shown) wherein upon expansion of the accordion structure, the pillowcase is opened up in a manner that permits a pillowcase to be inserted, is an alternative embodiment of the present invention.

In one embodiment of the invention, the device 18 is made from a single sheet of lexan polycarbonate, however, any sort of material, such as plastic, thin metal, cardboard, etc. can be used to create the device as claimed. Any material may be used so long as the material is cut, molded or otherwise formed to the appropriate size of a pillow and the material should be easily insertable and removable from a pillowcase. One particular embodiment of the invention is made to fit into standard pillowcases (with approximate dimensions of 23"×32½"). In various embodiments, the device 18 has a pillow insertion edge 20 that is rounded to ease the device into the pillowcase. A second edge, (the user interface edge), is opposite of the pillow insertion edge and has a handle cut out of material used to make the invention to aid the user in inserting and removing the device from a pillow case. The handles 24, 26 in this embodiment of the invention are cut out of the material of the invention, however, handles 26 can be attached on roughened surfaces or be non-existent dependant on the needs of the user. In yet a further embodiment, additional handholds are provided in the interior of planar material, for example, to facilitate the removal of the device from a pillowcase for a person having shorter arms where the length of the pillow may preclude withdrawal of the device in one motion while holding on to the exterior end of the device. For example, a handhold can be placed at about the middle and/or upper portion of the device, thus permitting a user to grip such handhold instead of the exterior end of the device and thereby withdraw the device from a pillowcase after insertion of a pillow with greater ease. In a preferred embodiment, both of the surfaces of the planar member are relatively smooth and allow a pillow and/or pillowcase material to slide easily against such surface or surfaces.

With the current invention, a user can take a pillowcase, insert the device 18 (pillow insertion edge 20 first) into the pillowcase, slide a pillow between the pillowcase and the pillow insertion device, and then remove the pillow insertion device. The process can be repeated for the next pillow.

In a preferred embodiment of the present invention, a substantially rounded cornered end 20 is provided such that the device can be easily inserted into a pillowcase without snagging on any slipcover corners. In other embodiments, all of the corners of the device are rounded to prevent unintended snagging or contact with other surfaces, and in particular, the pillowcase surfaces themselves.

Figure 2:
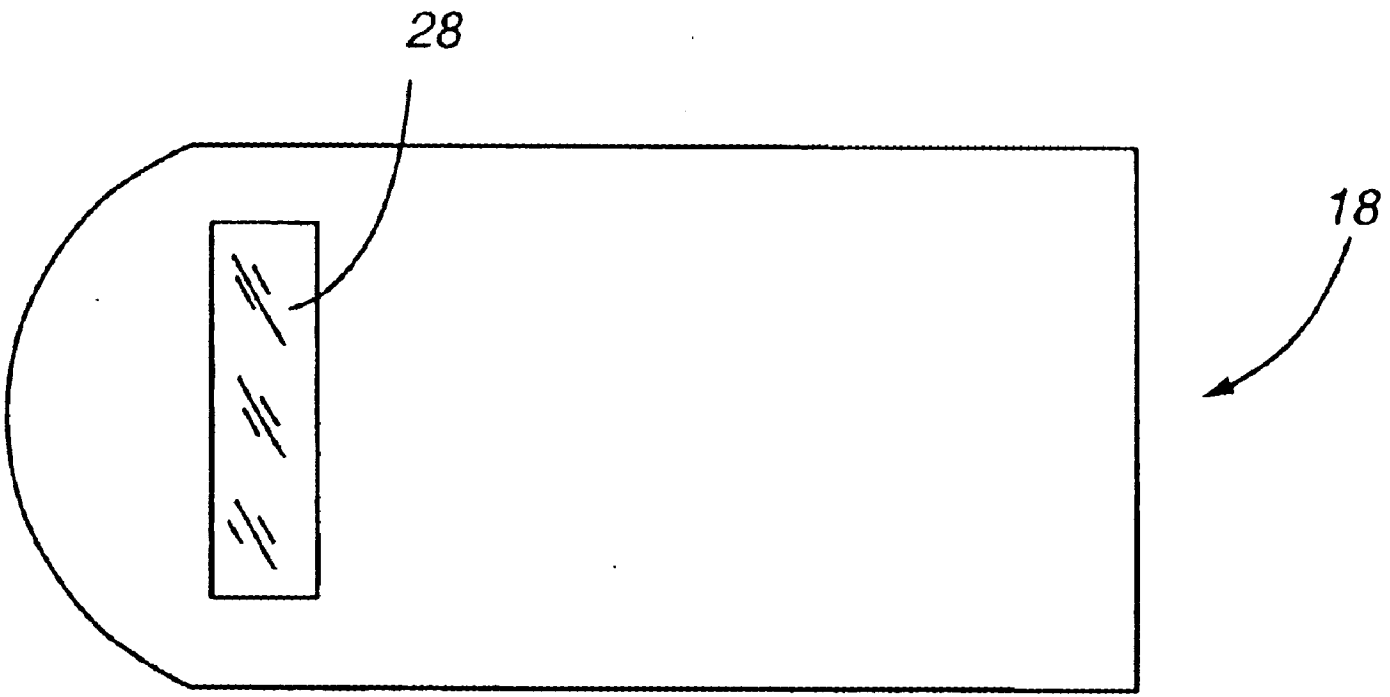
FIG. 2 is a view of another embodiment of the present invention showing a windowed enclosure associated therewith.

While the material utilized to construct the present invention can be of any particular flexible material, in one embodiment it is comprised of transparent plastic. Still other embodiments may include plastic that is easily printable so that the device itself can be identified as belonging to a particular hotel, etc. Indeed, the device can be manufactured with a particular graphic and/or printing to reflect its source and origin. In one particular embodiment of the present invention (FIG. 2), a windowed pocket 28 is provided on the device to facilitate insertion of printed material, logos, etc. in order to provide advertising and/or constructions, etc. Such a windowed enclosure can, for example, be adhesively attached to the flexible substrate of the present device around three of four edges, or as otherwise required, to facilitate insertion and extraction of printed/graphic material in or out of the transparent envelope. This embodiment provides an easily accessible way to inform maids of which rooms need service, etc. Thus, one aspect of the present invention includes a means for communicating information about the number of or identity of job service sites. It can also be used by maids to record what rooms have been serviced, etc. by having the maid check off completed assignments, etc.

Figure 4:
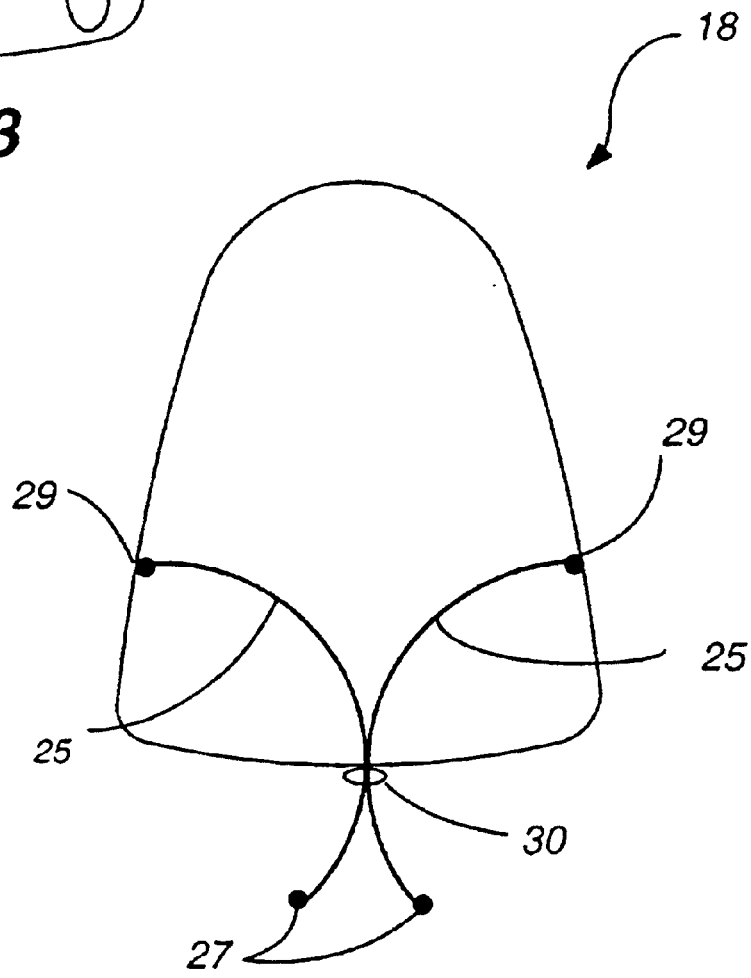
FIG. 4 illustrates one embodiment of the present invention utilizing pull cords to facilitate collapsing of the device into a desired U-shape for insertion into a pillowcase.
Figure 5:
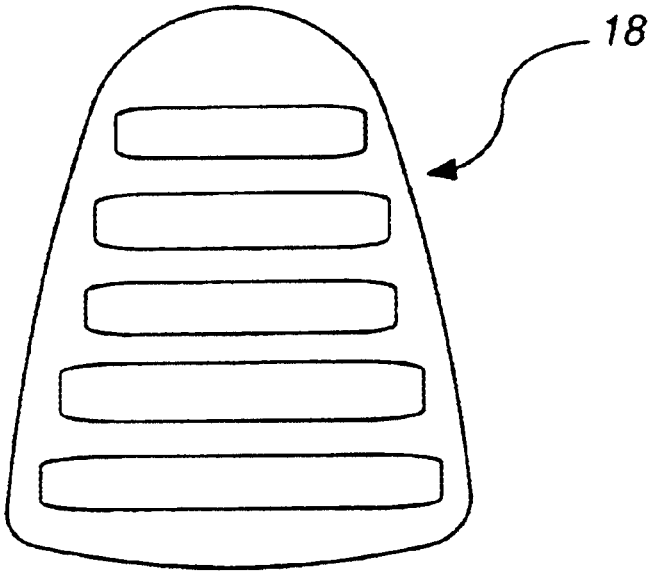
FIG. 5 illustrates an alternative embodiment of the present invention wherein large cut outs of material facilitate the manufacture of a device using less material, and thus being less costly, weighty, etc.
Figure 6:
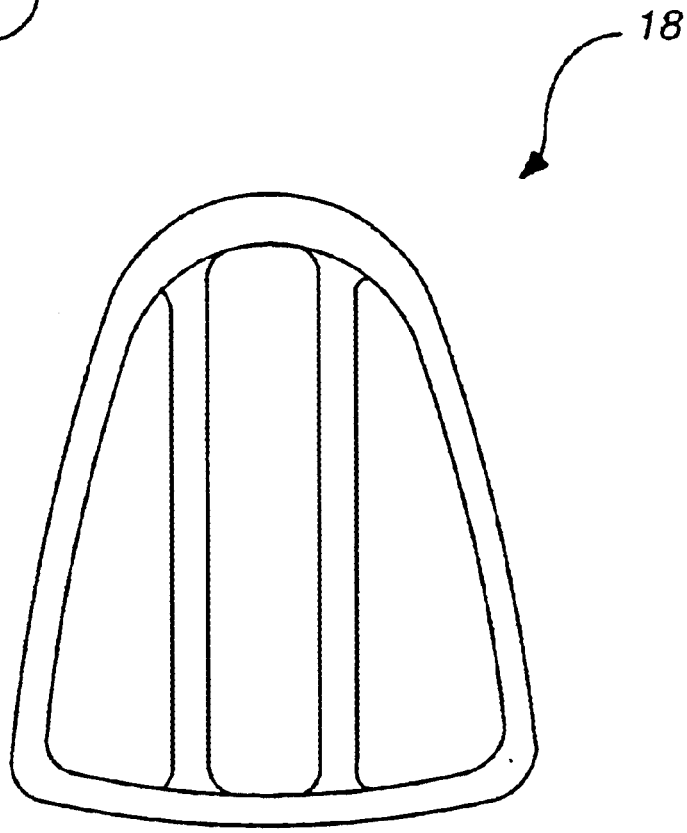
FIG. 6 illustrates an alternative embodiment of the present invention wherein the substantial portion of a center region of the device is an aperture and the device comprises principally a border of flexible material that can be conformed for use in the present method. Other embodiments include longitudinal extending materials to facilitate the proper bending/folding of the device.
Figure 7:
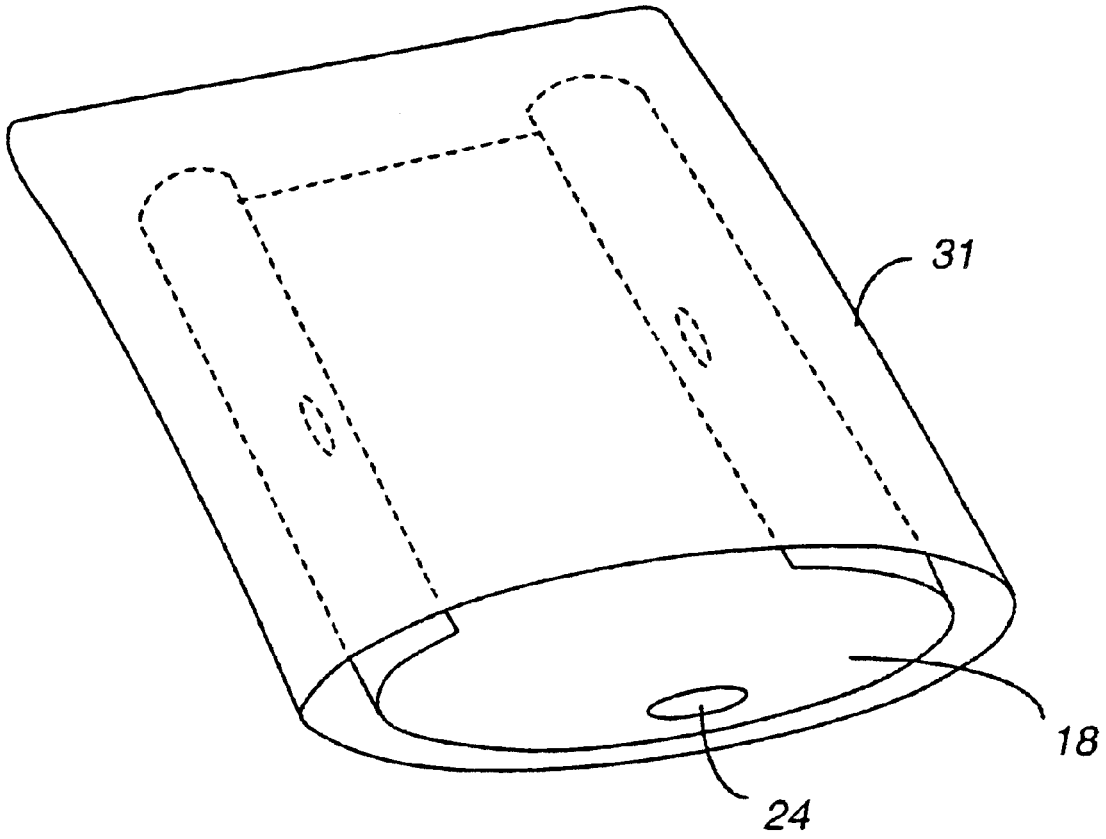
FIG. 7 illustrates one embodiment where a device of the present invention is holding open a pillow case after being inserted therein to accommodate insertion of a pillow into the pillowcase 31.

In one particular embodiment, (see, e.g., FIG. 4) the present device 18 is provided with two or more cords/strings 25 that are operatively associated with (connected by adhesive, rivets, etc.) to the side portions 29 of the device 18. A ring structure 30 (or other suitable conduit) is provided on the user interface edge of the device to accommodate the cord/strings 25. Knobs or handle portions 27 are connected to the end portions of the string/cords 25. By pulling on the knobs 27, the strings are pulled through the ring 30 and thereby collapse the device 18 so as to achieve a substantially U-shaped configuration, thus facilitating insertion of the device 18 into a pillowcase. It should be understood that such a U-shaped conforming mechanism can be used with any of the various embodiments of the present invention as described and as would be appreciated by one of ordinary skill in the art. It is believed that the simple mechanical action of pulling on the cords 25 to collapse the device 18, even further reduces the amount of repetitive stresses that may be encountered when a maid performs numerous pillowcase changing operations in any given day or week.

The actual dimensions of the present device 18 can be of any sort desired in order to facilitate the changing of various sized pillows in various sized pillowcases. Preferably, however, the width of the device 18 should exceed the width dimensions of any particular pillowcase in order to facilitate the creation of a three-dimensional space within the interior of the pillowcase so as to accommodate the insertion of a pillow with relative ease. In particular embodiments, therefore, the width of the device 18 is at least about 1½ times the width of a pillowcase, and in other embodiments, can exceed twice the width of the pillowcase. Given that a standard sized pillowcase opening is approximately 23 inches, the width of the present device should be in excess of approximately 25 inches, more preferably in excess of at least about 30 inches, and even more preferably, at least about 40 inches in width. The lengthwise dimension of the device 18 should be suitable for fitting within the complete interior length of a pillowcase, which is typically at least about 30 inches. More preferably, the length of the present device should exceed by several inches the length of a standard pillowcase in order to facilitate easy insertion and removal of the device without encountering any stearic hindrance from the pillowcase itself during the pillow changing operation. At least one portion of the device is preferably configured to extend substantially to the end of a pillowcase in order to facilitate the sliding of a pillow into the terminus of the pillowcase.

While the above discussion has been particularly directed to a device and method for inserting a pillow into a pillowcase, one of skill in the art will understand and appreciate that the present device, or reasonable modifications and adaptions thereto, can be utilized for other types of similar operations. For example, a similar type device and method can be employed in inserting contents into, for example, duffel bags, or any other type of fabric bag into which contents are to be inserted by an individual.

While various embodiments of the present invention have been described in detail, it will be apparent that further modifications and adaptations of the invention will occur to those skilled in the art. It is to be expressly understood that such modifications and adaptations are within the spirit and scope of the present invention, as set forth in the following claims.

What is claimed is:

1. A pillow insertion device comprising a relatively thin layer of a flexible material that has a generally rectangular shape, said device having first and second edges, said first edge being rounded to be inserted into a pillow case and said second edge adapted to be gripped by the user; and wherein said device has a longitudinal length and further comprising at least one handhold provided along said longitudinal length and two handholds provided on at least one of said two edges.

2. A pillow insertion device as claimed in claim 1, further comprising at least one elliptical-shaped handle formed in the thin layer.

3. A pillow insertion device as claimed in claim 1, wherein said device has a width of approximately at least 1½ times the width of a pillowcase into which said device is inserted.

4. A pillow insertion device as claimed in claim 1, wherein said flexible material comprises plastic.

5. The device as set forth in claim 1, wherein said flexible material has first and second surfaces and wherein both of said first and second surfaces are smooth and enable cloth material to be easily slidable with respect thereto.

6. A method of inserting a pillow into a pillowcase comprising:

a) opening a pillow case;

b) inserting a pillow insertion device comprising a flexible sheet of material that is formed into at least a generally U-shaped configuration, said sheet having at least one relatively smooth surface, pillow insertion side, into the pillow case;

c) sliding a pillow between along the surface of the pillow insertion device and the pillow case; and d) removing the pillow insertion device.

7. A pillow insertion device, comprising:

a planar sheet of flexible material conformable to a U-shaped configuration, said material having a rounded insertion end and having a length longer than a width dimension, said width dimension being at least 1½ times the width of a standard pillow case;

a handhold at a position opposite from said rounded end; and a windowed enclosure operatively associated with said device, said windowed enclosure capable of retaining a separate item of printed or graphic material.

8. A pillow insertion device, comprising:

a planar sheet of flexible material conformable to a U-shaped configuration, said material having a rounded insertion end and having a length longer than a width dimension, said width dimension being at least 1½ times the width of a standard pillow case;

a handhold at a position opposite from said rounded end; and two additional handholds are provided on opposite sides of the longitudinal length of said device.

9. A method for inserting a pillow into a pillowcase comprising:

a) providing a substantially planar, flexible piece of material having longitudinal edges and having a length longer than a pillowcase and a width wider than a pillowcase, said width dimension being at least about 1½ times the width of the pillowcase;

b) bringing together opposite edges along the longitudinal edges of said device so as to form a substantially U-shaped or O-shaped configuration;

c) inserting said U-shaped or O-shaped configuration into the interior of a pillowcase substantially completely into the interior of the pillowcase;

d) releasing the longitudinal edges of said device and permitting said device to attempt to return to its normal, substantially planar configuration whereby the interior of the pillowcase is urged into a three-dimensional cavity by said device;

e) inserting a pillow into said three-dimensional cavity created by said device; and f) withdrawing said device after the pillow is inserted into the interior of the pillowcase.

10. A pillow insertion device, comprising:

a planar sheet of flexible material in a substantially elliptical configuration, said material having a major diameter longer than a minor diameter; wherein said minor diameter being at least 1½ times the width of a standard pillow case; and a handhold at a position substantially in the middle of said device.

* * * * *